United States Patent [19]

Maeda

[11] 4,219,280

[45] Aug. 26, 1980

[54] WIRE PRINTER

[75] Inventor: Katsumi Maeda, Shizuoka, Japan

[73] Assignee: Star Seimitsu Kabushiki Kaisha, Shizuoka, Japan

[21] Appl. No.: 919,612

[22] Filed: Jun. 27, 1978

[30] Foreign Application Priority Data

Jun. 27, 1977 [JP] Japan ..... 52-75579

[51] Int. Cl.[2] ..... B41J 3/12

[52] U.S. Cl. ..... 400/124; 400/320

[58] Field of Search ..... 400/124, 320, 322, 328; 101/93.05; 74/57, 89.15

[56] References Cited

U.S. PATENT DOCUMENTS

| | | | |
|---|---|---|---|
| 2,911,085 | 11/1959 | Leathers | 400/124 |
| 3,572,238 | 3/1971 | Andersen | 400/162.1 |
| 3,949,851 | 4/1976 | Phelan | 400/125 |
| 4,053,040 | 10/1977 | McGourty | 400/124 X |

*Primary Examiner*—Paul T. Sewell

*Attorney, Agent, or Firm*—Robert E. Burns; Emmanuel J. Lobato; Bruce L. Adams

[57] ABSTRACT

A wire printer comprises a platen which guides a record medium, a carriage supported for reciprocable movement parallel to the platen, and a print head assembly carried by the carriage and including a plurality of print wires. The head assembly includes a plurality of print wires. The head assembly includes a plurality of solenoids, each of which is connected with one end of an associated print wire, the other end of which is disposed adjacent to the platen with a small clearance therebetween. The other end of each print wire is provided with a portion which is aligned with each other on a common vertical plane. The print head assembly is pivotally connected with the carriage and is guided to undergo a composite motion including an angular and a radial motion such that as the carriage is moved, a given point on the extension of the linear portion of the print wire moves along an imaginary centerline which passes through the center of stroke of the carriage and which is at right angles to the platen. The linear portion of the print wire has an offset angle from the platen which increases with an increase in the distance from the centerline. The maximum offset angle is chosen to be compatible with the practical printing operation.

13 Claims, 7 Drawing Figures

WIRE PRINTER

FIELD OF THE INVENTION

The invention relates to a wire printer including wires which form a dot matrix for printing, and more particularly, to a new drive system for a print head assembly which carries the wires.

A wire printer includes a plurality of solenoids, each of which is connected with one end of a print wire. When the solenoids are selectively energized, the other end of selected print wires imprint a desired letter or numeral on a record medium in the form of a dot matrix. A record medium such as paper is fed from a supply roll to travel across the platen while the print head moves along the lengthwise direction of the platen in opposing relationship with the record medium on the platen, thus achieving a printing along a line of the record medium. When a line has been printed and the print head reaches one end of the platen, it returns to the other end of the platen where the printing operation has been commenced. The record medium is then stepped forward to present a new line for printing.

DESCRIPTION OF THE PRIOR ART

A conventional wire printer includes a print head which moves in a direction parallel to the platen. By way of example, U.S. Pat. No. 3,592,311 issued to Albert S. Chou et al discloses a printer having a pair of guide shafts extending parallel to the platen and across which a print head is carried. The rotation of a worm which extends parallel to the guide shafts causes a translational movement of the print head. U.S. Pat. No. 4,062,436 issued to Nicholas Knodur, Jr. et al discloses a printer in which the worm is replaced by a drive disc mounted on a baseplate. An upstanding pin on the disc engages a groove cam formed in the lower surface of a print head support member so that the rotation of the disc is effective to cause an oscillating movement of the entire print head. However, the print head again moves parallel to the platen along a pair of guide shafts.

The movement of the print head assembly parallel to the platen is desirable since then the print wires will be always maintained perpendicular to the platen and hence the dots printed by the wires to form a letter or character have a clear profile. However, this involves the use of solenoids or other wire actuators of an increased weight which must be driven for translation, thus requiring a motor of an increased capacity. The rear end of the print head remote from the platen carries the solenoids, and hence has a fan-out or triangular configuration. When the print head is situated at the opposite ends of the platen, the rear end of head will project laterally beyond the baseplate, which means that the overall apparatus cannot be reduced in size with respect to the printable width.

SUMMARY OF THE INVENTION

It is an object of the invention to provide a wire printer having a print head capable of moving along a unique locus of motion, thereby eliminating the described disadvantages of the prior art.

It is another object of the invention to provide a wire printer which permits a motor of a reduced size to be used as compared with the prior art arrangement and which is simple in construction to permit a reduction in size.

In accordance with the invention, there is provided a wire printer comprising a baseplate, a platen along which a record medium is guided, a carriage supported on the baseplate for reciprocable movement parallel to the platen, drive means associated with the carriage, a print head assembly including a plurality of wires which are selectively movable to different points on a record medium, the assembly also including a housing for the print wires which has a wire support for providing linear portions at one end of the print wires which are aligned on a common vertical plane and also including a plurality of solenoids mounted on the housing and connected with the other end of each associated wire, means for connecting the head assembly with the carriage in a manner to permit angular movement thereof, and guide means for causing the head assembly to undergo a composite motion including an angular and a radial motion as the assembly is moved by the carriage such that a point on an extension of the linear portion of the print wire moves along an imaginary centerline which passes through the center of travel of the carriage and which extends at right angles to the platen.

According to the invention, the junction between the head assembly and the carriage, rather than the head assembly itself, moves parallel to the platen while the entire head assembly undergoes a composite motion including an angular and a radial motion. As a result of such motion, the linear portion of the print head has an offset angle relative to the platen which increases as it is further removed from the imaginary centerline. The maximum offset angle is chosen to be compatible with the practical printing operation.

The arrangement is such that when the forward end of the head assembly is located at an end of the platen, the rear end of the head assembly which has an increased width does not substantially project laterally beyond the baseplate, whereby the entire volume of the printer can be minimized. Since it is only necessary to accomplish a movement of the forward end portion of the head assembly which has a reduced weight, the motor used may be of low torque and small size, enabling the entire apparatus to be provided inexpensively.

DESCRIPTION OF PREFERRED EMBODIMENTS

Figure 1:
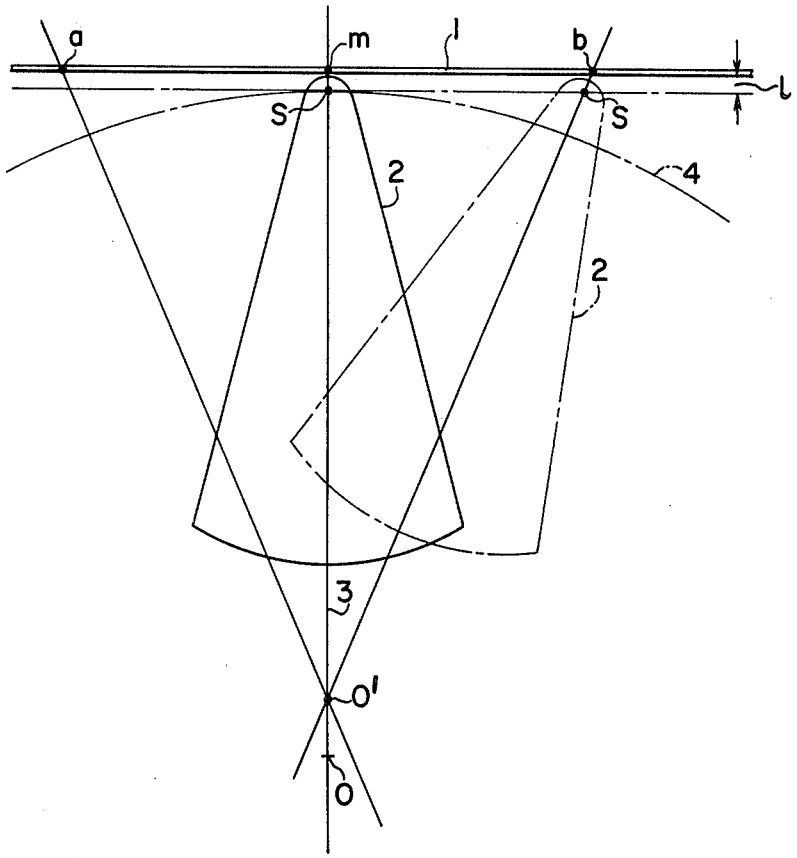
FIG. 1 is a diagrammatic view illustrating the principle of the printer of the invention.

Referring to FIG. 1, the principle of the invention will be initially described. FIG. 1 schematically shows a platen 1 and a print head assembly 2. The maximum extent along the platen 1 across which a printing operation can take place is defined by points a and b, with a middle point m located therebetween. When the head assembly is located as shown in solid line in FIG. 1 so that center S at the forward end of the head assembly is spaced by a distance l from the point m and the axis of the head assembly is aligned with a perpendicular 3 to the platen at point m, the head assembly 2 may be angularly driven about point o located on the perpendicular 3. As the point a or b is approached, the center S of the head assembly 2 will be spaced from the platen 1 by an increasing distance as it is removed from point m, as indicated by an arcuate line 4, making it impossible to achieve a printing operation. In order that the center S at the forward end of the head assembly 2 be maintained at a distance of l from the platen 1 across the entire range defined by the points a and b, it is necessary that the assembly be angularly driven about a different point o' located nearer the platen than the point o. However, when the movement of the assembly is centered about point o', the center S will be situated on the platen 1 as viewed in FIG. 1 when the axis of the assembly 2 is aligned with the perpendicular 3, thus preventing a printing operation and also interfering with an oscillating motion across points a, b. From the foregoing description, it will be seen that it is impossible to achieve an angular movement of the head assembly 2 while maintaining a constant distance between the platen 1 and the center S on the head assembly 2 if the assembly is caused to oscillate about a fixed point.

However, if the point about which the assembly 2 oscillates is moved from point o to point o' as the center S moves away from point m, or in other words, a translational movement of the assembly occurs simultaneously with the angular movement, in a direction diametrically of a circle which is formed by the angular movement, it is possible to maintain a substantially constant spacing between the platen 1 and the center S of the head assembly 2 at any position thereof intermediate the points a, b. The composite motion including the angular movement and the radial movement is what is contemplated by the present invention for the head assembly as it moves across the printable length along the platen.

An angular movement of the head assembly 2 means that an angle is formed between the print wires of the assembly 2 and the platen 1 as the forward end moves from point m to point a or b, and this may be considered undesirable from the standpoint of the prior art. However, it should be noted that an ink ribbon and a record medium are interposed between the end of print wires and the platen, and are slightly compressed during the print operation so that a certain angle formed between the print wires and the platen presents no difficulties for practical purposes. By experiments, it is found that when the print wires have a diameter of 0.3 mm and a print stroke of 0.5 mm, a maximum offset angle of 12° of the print wires relative to a perpendicular to the platen does not result in a distortion of a printed character or the failure of any dot to be printed. Thus, it is fully possible to manufacture a usual journal printer having a printable width of 50 mm while allowing such offset angle.

In the following Figures, several embodiments of the invention are illustrated. It should be noted that corresponding parts are designated by like numerals throughout the drawings.

Figure 3:
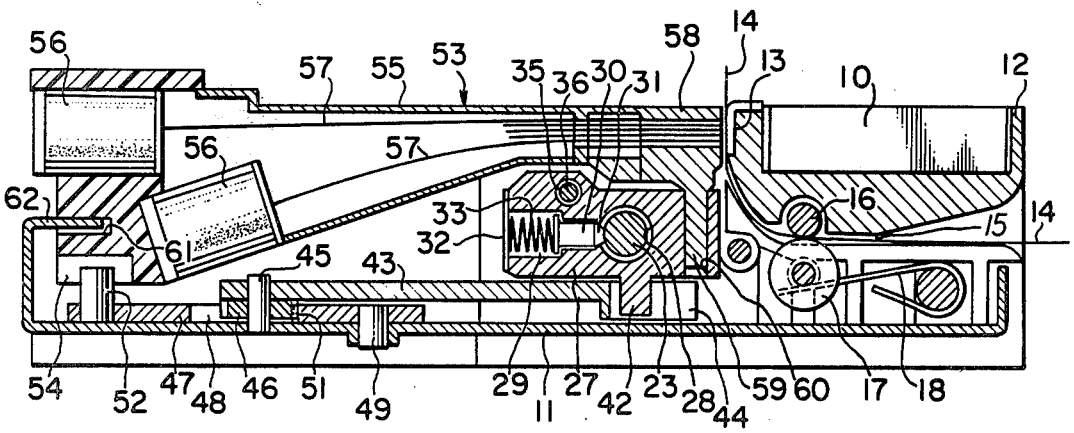
FIG. 3 is a cross section taken along the line 2—2 shown in FIG. 2.
Figure 2:
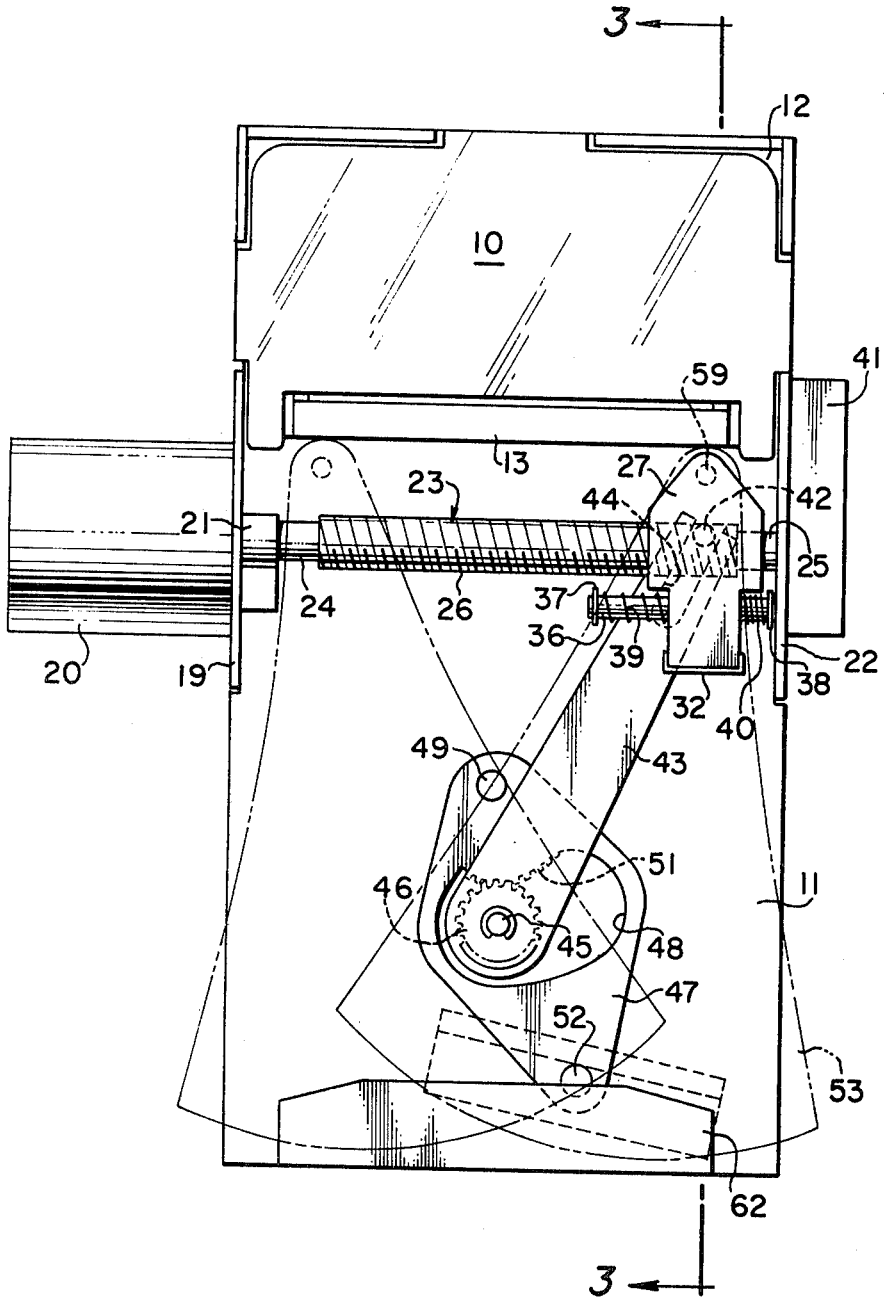
FIG. 2 is a plan view of a first embodiment of the invention.

FIGS. 2 and 3 show a first embodiment of the invention including a rectangular baseplate 11, the front end, as viewed in FIG. 2, of which is provided with a frame 12 carrying an ink ribbon cartridge 10. An L-shaped platen 13 is mounted on the front end of the frame 12 so that its one limb lies in a vertical plane. The frame 12 is formed with a guide passage 15 for record medium 14 such as paper, and a pair of feed rollers 16, 17 extending crosswise of the medium is disposed in the passage 15. Feed roller 17 is normally biased by spring 18 into abutment against feed roller 16.

The baseplate 11 includes a sidewall 19 on which a reversible motor 20 is mounted. Motor 20 has a rotating shaft 21, which is connected with one end of a drive shaft 23 extending parallel to the platen 13 with a uniform spacing therebetween. The other end of drive shaft 23 is rotatably mounted in the opposite sidewall 22. Except for its opposite end regions 24, 25, the drive shaft 23 is formed as a worm 26, which is loosely fitted in a bore 28 formed in a carriage 27. As shown in FIG. 3, the carriage 27 is formed with another bore 29 which extends at right angles to the axis of drive shaft 23 and into which a half nut 30 is fitted for abutment against the worm 26. The inner end 31 of half nut 30 is formed with a rack engageable with the worm 26. Spring 33 is disposed between the other end of the half nut 30 and an end cover 32 which closes the bore 29, thus maintaining the inner end 31 in engagement with the worm 26. Carriage 27 is also formed with a through-hole 35 extending parallel to the bore 28 and in which a stop bar 36 is loosely fitted, the bar 36 having a greater length than that of the through-hole 35. The opposite ends of the stop bar 36 is provided with flanges 37, 38, and springs 39, 40 are disposed on the bar between the flanges 37, 38 and the carriage 27. The other end of the drive shaft 23 is connected with a gear box 41 which includes a reduction gearing and a clutch of a known construction, whereby the rotation of the drive shaft 23 is transmitted to the feed roller 16.

On its bottom, the carriage 27 is centrally provided with a pin 42 downwardly projecting therefrom and which is engaged by a slit 44 formed in a lever 43 adjacent to one end thereof. The other end of lever 43 is pivotally mounted on the baseplate 11 by means of pin 45. A gear 46 is integrally mounted on the pin 45 on the underside of the lever 43, and is located on an imaginary centerline struck from the center point of the stroke of carriage 27 in a direction perpendicular to the platen 13. The gear 46 is fitted in an elongate slot 48 formed in a diamond-shaped plate 47. On its underside, the plate 47 fixedly carries a pin 49 which is pivotally mounted on the baseplate 11 on the imaginary centerline. Part of the periphery of the slot 48 is formed with a toothed portion 51 which is in meshing engagement with the gear 46. It is to be noted that the toothed portion 51 is centered about the pin 49. On its other end, the plate 47 fixedly carries a pin 52 which is located on the upper surface of the plate.

The pin 52 engages a print head assembly 53. The assembly 53 includes a head housing 55 having a slot 54 formed in the rear end thereof and in which the pin 52 is fitted. Head housing 55 is generally sector-shaped, fanning out in the rear or outer direction and carries seven solenoids 56 of a substantial mass or weight on the rear portion thereof which are disposed radially. A plurality of print wires 57 have their one end (actuating end) connected with an associated one of solenoids 56 and their other end (printing end) supported by a wire support 58 located on the inner end of the sector-shaped housing. The wire support 58 aligns the printing ends of seven print wires 57 which extend radially from the associated solenoids 56 on a common vertical plane and controls them to project therefrom in a linear fashion. On its underside, the wire support 58 has a downwardly depending pin 59 which lies in the same vertical plane as the wires 57 and which is fitted into a hole 60 formed in the inner end of the carriage 27. In its rear end, the head housing 55 is formed with an elongate groove 61 which extends parallel to the baseplate 11 and which loosely receives a guide 62 that is formed as a folded extension of the baseplate 11.

The mechanism which intermittently drives the feed roller 16 as the motor 20 rotates as well as the layout of and the drive mechanism associated with the solenoids 56 are similar in construction to those of conventional wire printers, and therefore will not be described.

In operation, the feed roller 16 is driven to feed record medium 14 over the platen 13, whereupon it is stopped. Referring to FIG. 2, the rack formed on the inner end 31 of the half nut 30 is located opposite to the right-hand non-threaded end 25 of the drive shaft 23, so that the carriage 27 cannot move further to the right if the motor 20 is driven in the forward direction. The flange 38 of the stop bar 36 abuts against the sidewall 22, whereby spring 40 located on the right-hand side of the carriage 27 is compressed. Consequently, when the motor 20 rotates in the reverse direction, the threads on the inner end 31 of the half nut 30 is urged by the compressed spring 40 into threadable engagement with the right-hand end of the worm 26 on the rotating drive shaft 23, and thus moves to the left.

During such movement, the pin 42 depending from the carriage 27 causes the lever 43 to rotate counter-clockwise about the pin 45. The gear 46 is also roated counter-clockwise about the pin 45, and its meshing toothed portion 51 causes the diamond-shaped plate 47 to rotate clockwise about the pin 49. The clockwise rotation of plate 47 causes the pin 52 to drive the rear or outer end of the head assembly 53 to the left, as viewed in FIG. 2. The spacing between the pins 49, 52 on the plate 47 is substantially reduced as compared with the spacing between the pin 42 on the carriage 27 and the pin 45 on the lever 43, so that the head assembly 53 which extends across the carriage 27 and the pin 52 will have a reduced speed of movement at its outer end than the speed movement at its inner end. In other words, the outer end of the head assembly 53 will move through a reduced stroke as compared to the stroke through which its inner end moves. The connection between the lever 43 and carriage 27 is effected by fitting the pin 42 extending from the carriage 27 into the elongate slit 44 formed in the lever 43 while the connection between the diamond-shaped plate 47 and the outer end of the head assembly 53 is effected by fitting the pin on the plate 47 into the elongate slot 54 formed in the head assembly 53. It is to be noted that the slot 54 is aligned with the imaginary centerline when the head assembly 53 is located on this centerline. Stated differently, it is located on an extension of a line joining the pin 59 on the carriage 27 and the pin 52 on the plate 47. As a consequence, as the inner end of the assembly 53 approaches the center of the platen 13, the pin 42 moves into the slit 44 while the pin on the plate 47 moves through the elongate slot 54 formed in the assembly 53. Therefore, it will be seen that the point of intersection between the extension of the line joining the pins 59, 52 and the imaginary centerline which passes through the center of stroke of the carriage 27 in a direction perpendicular to the platen 13 moves along the imaginary centerline.

It then follows that the inner end of the head assembly 53 moves to the left, as viewed in FIG. 2, without abutting against the platen 13. When the inner end of the assembly 53 reaches the left-hand end, the outer end of the head assembly 53 which has an increased width because of the fan-out configuration will only slightly project beyond the edge of the baseplate 11, at its left-hand end. Subsequently when the motor 20 is rotated in the forward direction, the carriage 27 moves from left to right, accompanying a corresponding movement of the head assembly 53 until the position shown in FIG. 2 is resumed.

The motor 20 rotates in the forward direction when a print signal is applied to the solenoids 56. During five steps, print wires 57 are selected in accordance with the print signal to form a character on record medium 14 by a selected combination of $7\times5=35$ dots. When the print signal is removed, the motor 20 rotates in the reverse direction, returning the head assembly 53 to its original position while feeding record medium by an amount corresponding to one line.

A practical apparatus has been constructed having a maximum printable width of 50 mm. The spacing between the inner end of the wire support 58 and the platen 13 is chosen to be 0.38 mm. The dot matrix comprises print wires having a diameter of 0.3 mm and a stroke of 0.5 mm. The drive shaft 23 is driven for rotation by motor 20 which rotates at the rate of 8400 r.p.m. When a maximum of twenty characters is printed, one reciprocatory motion of the head assembly 53 is completed within 0.4 second. An angle of 12° is formed between the imaginary centerline struck from the center of the platen 13 in a direction perpendicular thereto and an extension of print wires 57 supported by the support 58 when the print head is located at opposite ends of the platen. Neither the failure of printing of any one dot nor distorsion of the printed characters occurs.

Figure 4:
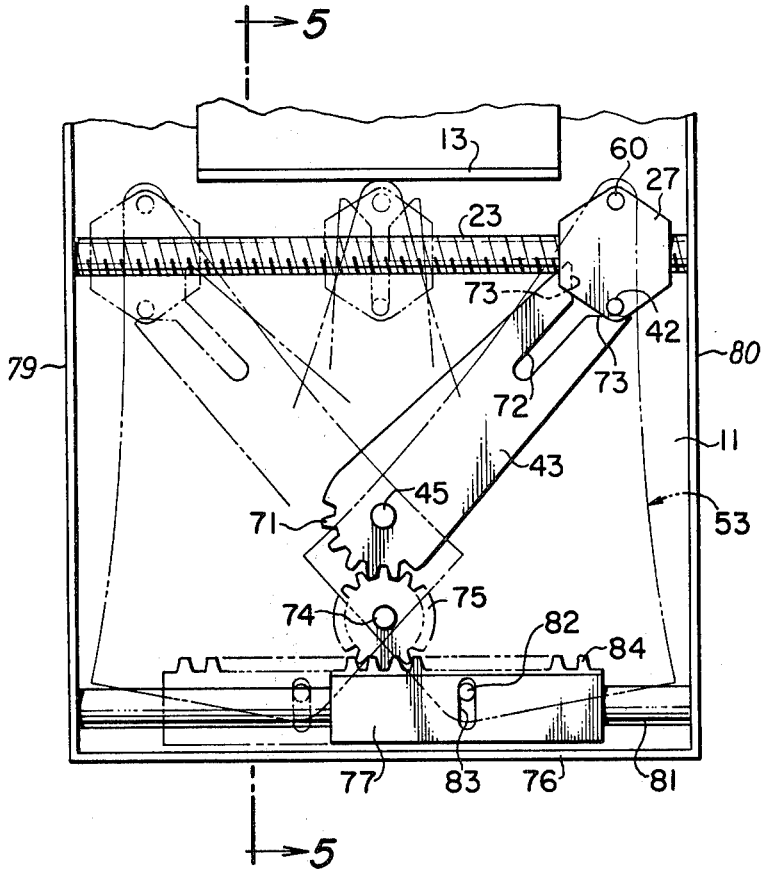
FIG. 4 is a plan view of a second embodiment.
Figure 5:
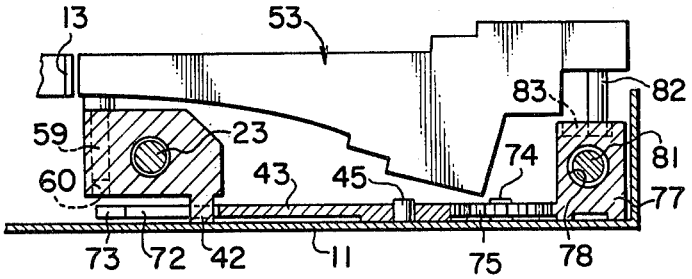
FIG. 5 is a cross section taken along the line 5—5 shown in FIG. 4.

FIGS. 4 and 5 show another embodiment including guide means which causes the print head assembly 53 to undergo a composite motion including an angular and a radial motion. In this embodiment, drive means associated with the carriage 27 is not shown, but the carriage 27 may be supported by a guide rod which is substituted for the worm shaft, and the drive means may comprise an endless wire drive of known construction, for example. Lever 43 is pivotally mounted on the baseplate 11 by means of pin 45, and its outer end is peripherally formed with a toothed portion 71. The inner end of lever 43 is formed with a slit 72 into which pin 42 on the carriage 27 is fitted. The open end of the slit 72 is formed as a bevelled surface 73 which presents an increasing aperture outwardly. Pinion 75 is rotatably mounted on the baseplate 11 by means of pin 74 so as to mesh with the toothed portion 71 of the lever 43. Pin 74 is located on the imaginary centerline passing through the center of travel of the carriage 27 in the similar manner as the pin 45. Pinion 75 meshes with a rack member 77 which is disposed slidable along the front edge 76 of the baseplate 11. Rack member 77 is formed with a bore 78 extending therethrough and in which a support rod member 81 is passed to extend parallel to the platen 13, thus slidably carrying the rack member 77. The opposite ends of rod member 81 are supported by sidewalls 79, 80 of the baseplate. The pin 59 located on the inner end of the head assembly 53 is fitted into the hole 60 formed in the carriage 27 in the similar manner as in the previous embodiment, but the outer end of the head assembly 53 is supported by the rack member 77 by having a pin 82 depending from the underside of the outer end of the assembly engaged in an opening 83 which is centrally formed in the upper surface of the rack member 77 and which is elongate in a direction parallel to the imaginary centerline or perpendicular to the platen 13.

In operation, as the carriage 27 moves to the left from the position shown in FIG. 4, pin 42 engaging one of the bevelled surfaces 73 of the lever 43 moves into the slot or slit 72, causing a counter-clockwise rotation of the lever 43. The angular movement of the lever causes the pinion 75 to rotate clockwise, whereby rack member 77 is moved to the left. As the carriage 27 approaches the center, pin 82 extending from the assembly 53 moves within the elongate slot or opening 83 formed in the rack member 77. It will be seen that the head assembly 53 undergoes a composite motion including an angular and a radial motion such that the point of intersection between an imaginary line extending through the pins 59, 82 (the linear portion of the print wires being located in a vertical plane which is aligned with such line) and an imaginary line passing through the center of travel of the carriage 27 and perpendicular to the platen 13 moves along the latter imaginary line.

In this embodiment, as the carriage 27 approaches either end of the platen 13, the pin 42 moves out of the slit, whereby the lever 43 ceases to rotate, interrupting movement of the rack member 77. When the carriage 27 moves further, the pin 82 allows the head assembly 53 to follow such movement of the carriage 27 while it moves within the opening 83. Such additional movement will be useful to move the carriage 27 further away from the platen 13 in order to check the printing result or to replace the sheet of paper.

Figure 6:
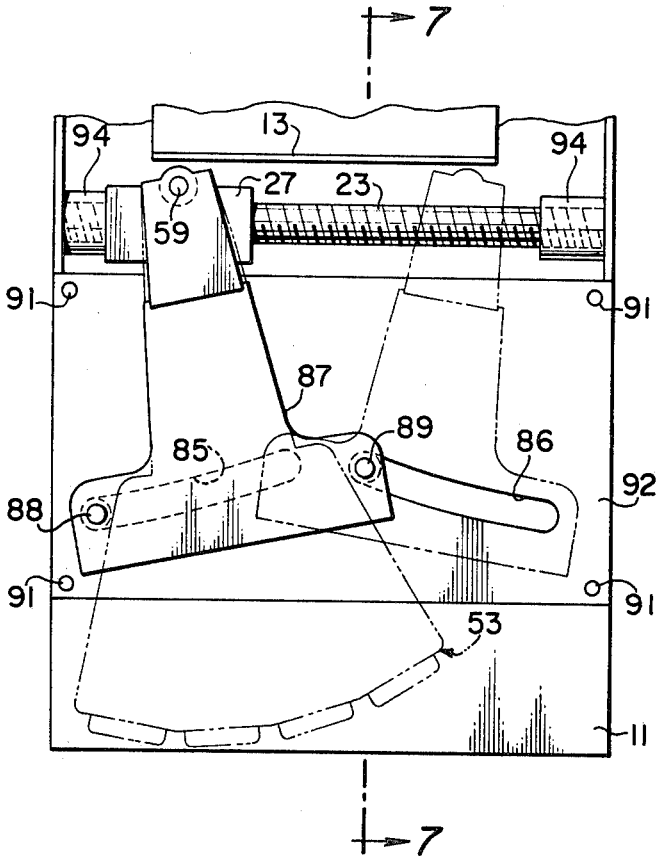
FIG. 6 is a plan view of a further embodiment.
Figure 7:
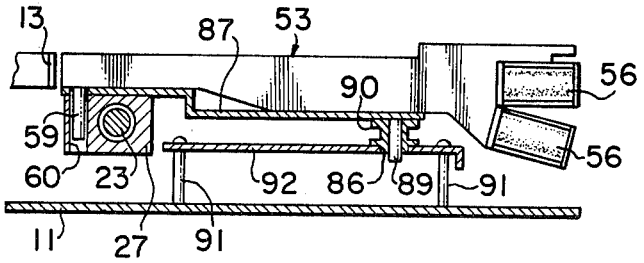
FIG. 7 is a cross section taken along the line 7—7 shown in FIG. 6.

FIGS. 6 and 7 show essential parts of a third embodiment of the invention. In this instance, a pair of guide slots 85, 86 formed symmetrically with respect to the imaginary centerline passing through the center of travel of the carriage 27 guides the head assembly 53 so as to undergo a composite motion including an angular and a translational or radial motion. Drive means associated with the carriage 27 is not shown, but may comprise any known means which drives the carriage to move parallel to the platen 13. Head support plate 87 is secured to the underside of the head assembly 53 and has a pair of downwardly depending pins 88, 89 which extend from the opposite sides of the outer end (the lower end, as viewed in FIG. 6) thereof. A sleeve 90 formed of a material such as metal or synthetic resin which presents a reduced frictional resistance is fitted on each pin 88, 89, which is then inserted into the guide slots 85, 86 to form pin-and-slot connections. These slots are formed in a support plate 92 which is maintained in a horizontal position by being mounted on the baseplate 11 by means of mounting pins 91. The guide slots 85, 86 form an angle with respect to the imaginary centerline which passes through the center of travel of the carriage 27 in a direction perpendicular to the platen 13, and are arcuate in configuration. Such configuration of the guide slots 85, 86 represent a locus of movement of pins 88, 89 as the head assembly 53 is moved in accordance with the principle of the invention illustrated in FIG. 1 during the movement of the carriage 27 from one end to the other end of the drive shaft 23.

When the carriage 27 is located on the left-hand end as shown in FIG. 6, pin 88 is located in the left-hand end of the guide slot 85 while pin 89 is located in the left-hand end of the guide slot 86. When the carriage 27 assumes its central position, pins 88, 89 assume an intermediate position within the corresponding guide slots 85, 86 and the inner end of the head assembly 53 is directed at right angles to the platen 13. As the carriage 27 further moves to the right, the head assembly 53 assumes an angular position in which it is inclined to the right, and when the carriage 27 reaches the right-hand end of its stroke, pins 88, 89 are located in the right-hand end of the respective guide slots 85, 86. Again it will be noted that the print head assembly 53 undergoes a composite motion including an angular and a radial motion in which a point of intersection between an imaginary line joining the pin 59 and the median point between the pins 88, 89 on the head assembly 53 (it being understood that the linear portions of the print wires are located on a plane which coincides with this imaginary line) and another imaginary line passing through the center of travel of the carriage 27 in a direction perpendicular to the platen 13 moves along the latter imaginary line. It is to be noted that the stop bar and springs used in the embodiment of FIGS. 2 and 3 are replaced by resilient stops mounted on the opposite ends of the drive shaft 23.

What is claimed is:

1. A wire printer comprising: a baseplate; a platen for guiding a record medium thereon; a carriage mounted on the baseplate for reciprocating movement parallel to the platen; drive means for reciprocating the carriage; a print head assembly including a plurality of print wires which are selectively movable to different points on the record medium, a housing for the print wires having a wire support which aligns one end of the print wires on a common vertical plane and allowing a linear portion thereof to extend from the support, and a plurality of solenoids mounted on the housing each connected with the other end of respective ones of the print wires; means for connecting the inner end of the head assembly which is located nearer the platen on the carriage in a manner to permit its angular movement relative to the latter; and guide means for movably supporting the outer end of the head assembly which is remote from the platen such that as the head assembly is carried by the carriage, the head assembly undergoes a composite motion including an angular and a radial motion such that a point on an extension of the linear portion of the print wire moves along an imaginary centerline passing through the center of stroke of the carriage in a direction perpendicular to the platen, the guide means comprising a first guide member having its one end pivotally mounted on the baseplate in alignment with the imaginary centerline and its other end slidably and pivotally engaged with the carriage, a second guide member having its one end pivotally mounted on the baseplate in alignment with the imaginary centerline and its other end slidably and pivotally engaged with the outer end of the head assembly, and connection means for connecting the second guide member with the first guide member in a manner to permit the second guide member to follow the angular movement of the first guide member in an opposite direction, the connection means including a first gear fixedly mounted on one end of the first guide member and a second gear meshing with the first gear and mounted on one end of the second guide member.

2. A wire printer according to claim 1 in which the second guide member is formed with a notch in which the first gear is received, the second gear being formed on an edge of the notch.

3. A wire printer according to claim 1 in which the carriage has a pin, and the first guide member is formed with a lengthwise elongate slit in its other end which is engaged by the pin, the head assembly being formed with another slit which is aligned with the imaginary centerline when the assembly is located on the centerline, the second guide member having a pin on its other end which engages the slit formed in the head assembly.

4. A wire printer comprising: a baseplate; a platen for guiding a record medium thereon; a carriage mounted on the baseplate for reciprocating movement parallel to the platen; drive means for reciprocating the carriage; a print head assembly including a plurality of print wires which are selectively movable to different points on the record medium, a housing for the print wires having a wire support which aligns one end of the print wires on a common vertical plane and allowing a linear portion thereof to extend from the support, and a plurality of solenoids mounted on the housing each connected with the other end of respective ones of the print wires; means for connecting the inner end of the head assembly which is located nearer the platen on the carriage in a manner to permit its angular movement relative to the latter; and guide means for movably supporting the outer end of the head assembly which is remote from the platen such that as the head assembly is carried by the carriage, the head assembly undergoes a composite motion including an angular and a radial motion such that a point on an extension of the linear portion of the print wire moves along an imaginary centerline passing through the center of stroke of the carriage in a direction perpendicular to the platen, the guide means comprising a lever member having its one end pivotally mounted on the baseplate in alignment with the imaginary centerline and its other end slidably and pivotally engaged with the carriage and having a toothed portion formed around the periphery of said one end, a pinion member rotatably mounted on the baseplate in alignment with the imaginary centerline and meshing with the toothed portion, and a sliding member mounted to be slidable in a direction parallel to the platen and having a rack which meshes with the pinion member, the sliding member slidably and pivotally engaging the outer end of the head assembly.

5. A wire printer according to claim 4 in which the carriage has a pin which engages a slot formed in the outer end of the guide member and which is elongate lengthwise thereof, and wherein the head assembly has a pin which is engaged with a slot formed in the sliding member and which is elongate in a direction perpendicular to the platen.

6. A wire printer comprising: a baseplate; a platen for guiding a record medium thereon; a carriage mounted on the baseplate for reciprocating movement parallel to the platen; drive means for reciprocating the carriage; a print head assembly including a plurality of print wires which are selectively movable to different points on the record medium, a housing for the print wires having a wire support which aligns one end of the print wires on a common vertical plane and allowing a linear portion thereof to extend from the support, and a plurality of solenoids mounted on the housing each connected with the other end of respective ones of the print wires; means for connecting the inner end of the head assembly which is located nearer the platen on the carriage in a manner to permit its angular movement relative to the latter; and guide means for movably supporting the outer end of the head assembly which is remote from the platen, the guide means including a pair of guide pins provided on the outer end of the head assembly and extending in a direction perpendicular to the baseplate, a support plate member extending parallel to the baseplate, and slot means in the support plate member engageable with the guide pins, the slot means forming an angle with respect to the imaginary centerline which passes through the center of travel of the carriage in a direction perpendicular to the platen.

7. A wire printer according to claim 6 in which the slot means comprises a pair of slots formed symmetrically with respect to the imaginary centerline and each engaging with a respective one of the guide pins.

8. A wire printer according to claim 6 in which the guide means further includes a sleeve fitted on each pin and formed of a material having reduced frictional resistance, one end of each sleeve engaging at the edge of the slot means.

9. In a wire printer of the type having a linear platen over which advances a record medium; and a movable print head assembly containing a plurality of selectively actuatable print wires having printing ends spaced from the platen and movable in a line along the length of the platen to enable printing of a line of characters on the record medium: drive means for reciprocably driving one part of said print head assembly with a linear motion through forward and return strokes along a linear line parallel to the platen; and guide means coacting with said drive means for guiding said print head assembly to undergo composite angular and translational motion to effect substantially linear movement of the printing ends of said print wires along a linear line parallel to the platen to enable printing of a line of characters on the record medium in response to linear motion of said one part of said print head assembly through one stroke, said guide means including means defining a set of guide slots disposed at an angle with respect to the linear line of motion of said one part of said print head assembly, and a set of guide pins slideable in said guide slots and defining therewith pin-and-slot connections, one of said sets of guide slots and pins being on said print head assembly.

10. A wire printer according to claim 9; including means connecting said guide pins on said print head assembly.

11. A wire printer according to claim 9; wherein said guide slots are arcuate in configuration.

12. A wire printer according to any one of claims 9, 10 and 11; wherein said one part of said print head assembly which is driven by said drive means is positioned at the end of said print head assembly situated adjacent the platen.

13. A wire printer according to any one of claims 9, 10 and 11; wherein said pin-and-slot connections are positioned between the lengthwise ends of said print head assembly.

* * * * *